US010232972B1

(12) United States Patent
Grill

(10) Patent No.: US 10,232,972 B1
(45) Date of Patent: Mar. 19, 2019

(54) CUP ASSEMBLY FOR HOLDING TOUCH-UP PAINT AND A METHOD OF USING THE SAME

(71) Applicant: Jason E. Grill, Liberty Township, OH (US)

(72) Inventor: Jason E. Grill, Liberty Township, OH (US)

( * ) Notice: Subject to any disclaimer, the term of this patent is extended or adjusted under 35 U.S.C. 154(b) by 126 days.

(21) Appl. No.: 15/099,480

(22) Filed: Apr. 14, 2016

Related U.S. Application Data

(60) Provisional application No. 62/151,949, filed on Apr. 23, 2015.

(51) Int. Cl.
*B44D 3/12* (2006.01)
*B65D 23/04* (2006.01)
*B65D 1/10* (2006.01)

(52) U.S. Cl.
CPC ..... *B65D 1/10* (2013.01); *B44D 3/12* (2013.01); *B44D 3/127* (2013.01); *B65D 23/04* (2013.01)

(58) Field of Classification Search
CPC .. A47G 19/2205; A47G 19/2255; B65D 1/10; B65D 1/16; B65D 21/0228; B65D 21/023; B65D 21/0231; B65D 21/02; B65D 21/0209; B65D 21/0212; B65D 21/0217; B65D 21/0219; B65D 21/022; B65D 21/0222; B65D 21/0223; B65D 81/32; B65D 81/3205
USPC ..... 220/288, 23.83, 23.86, 4.01, 293, 300, 220/301, 298; 215/6; 206/216, 217
See application file for complete search history.

(56) References Cited

U.S. PATENT DOCUMENTS

D666,047 S * 8/2012 Lin ..... D7/300.1
8,939,305 B2 * 1/2015 Meyers ..... B65D 47/0885 220/254.4
2012/0305416 A1 * 12/2012 Miyabe ..... A45D 34/00 206/223

* cited by examiner

*Primary Examiner* — Steven A. Reynolds
*Assistant Examiner* — Javier A Pagan
(74) *Attorney, Agent, or Firm* — The Law Office of Patrick F. O'Reilly III, LLC

(57) ABSTRACT

A cup assembly for holding touch-up paint is disclosed herein. The cup assembly includes a cup portion with a fluid reservoir configured to hold a volume of touch-up paint; a lid portion configured to matingly engage with the cup portion in a substantially airtight manner so as to prevent the volume of touch-up paint from solidifying; and a shaker ball disposed inside the fluid reservoir of the cup portion, the shaker ball configured to agitate the volume of touch-up paint in the fluid reservoir. A method of applying touch-up paint, which utilizes the cup assembly, is also disclosed herein.

17 Claims, 3 Drawing Sheets

Section A-A

CUP ASSEMBLY FOR HOLDING TOUCH-UP PAINT AND A METHOD OF USING THE SAME

CROSS-REFERENCE TO RELATED APPLICATIONS

This patent application claims priority to, and incorporates by reference in its entirety, U.S. Provisional Patent Application No. 62/151,949, entitled "Cup Assembly For Holding Touch-Up Paint And A Method Of Using The Same", filed on Apr. 23, 2015.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a cup assembly. More particularly, the invention relates to a cup assembly for holding touch-up paint and a method of using the same.

2. Background

In one's home, it is often necessary to touch up scratches or marks on various interior surfaces in order to maintain a desirable appearance (e.g., when the paint on a wall and/or ceiling becomes damaged by virtue of being contacted with an object). The need to touch up scratches or marks on interior surfaces is particularly prevalent in homes having children and/or pets. In particular, children and/or pets tend to frequently come into contact with the walls of a home, which may lead to marks and/or scratches thereon.

Interior home paint is typically sold in one gallon containers. However, it is both inconvenient and time consuming for a user to open an entire gallon of paint each time he or she simply wants to touch up a small mark or scratch on an interior surface of his or her home. In addition, the frequent opening of the large paint container increases the exposure of the paint inside the container to air, and thus, may decrease the useful life of the paint inside the container. Also, typical one gallon paint containers do not contain any simple means to stir or agitate the paint disposed inside. As such, a separate paint stirrer or paddle is always required to mix up the paint inside the one gallon paint container. The use of the separate paint stirrer or paddle makes the touch-up painting process more inconvenient and time consuming because the user typically has to separately clean the paint stirrer or paddle after its use.

Therefore, what is needed is a cup assembly for holding touch-up paint that includes an integral means for agitating or stirring the paint stored in the cup so that a separate paint stirrer or paddle is not required for mixing the touch-up paint. Moreover, a paint cup assembly is needed that is capable of storing the touch-up paint disposed therein in a generally airtight manner so that the paint does not dry up between the uses thereof. Furthermore, there is a need for a paint cup assembly that is specifically configured to accommodate a relatively small volume of touch-up paint for enabling a user to conveniently touch up interior surfaces, such as walls, trim, ceilings, and doors. In addition, there is a need for a method of applying touch-up paint that utilizes the paint cup assembly, thereby significantly facilitating the ease by which an interior surface may be touched up with paint.

BRIEF SUMMARY OF EMBODIMENTS OF THE INVENTION

Accordingly, the present invention is directed to a cup assembly for holding touch-up paint and a method of using the same that substantially obviates one or more problems resulting from the limitations and deficiencies of the related art.

In accordance with one or more embodiments of the present invention, there is provided a cup assembly for holding touch-up paint. The cup assembly comprises a cup portion, the cup portion including a fluid reservoir configured to hold a volume of touch-up paint; a lid portion, the lid portion configured to matingly engage with the cup portion in a substantially airtight manner so as to prevent the volume of touch-up paint from solidifying; and a shaker ball disposed inside the fluid reservoir of the cup portion, the shaker ball configured to agitate the volume of touch-up paint in the fluid reservoir.

In a further embodiment of the present invention, the cup portion further includes a rim with a plurality of external threads disposed thereon, and the lid portion further includes collar with a plurality of internal threads disposed thereon. In this further embodiment, the plurality of external threads on the cup portion are configured to matingly engage with the plurality of internal threads on the lid portion in a substantially airtight manner.

In yet a further embodiment, an exterior surface of the cup portion further includes an area for accommodating a label.

In still a further embodiment, the cup portion has a generally cylindrical shape with a circular sidewall that has a slight outward taper from a base of the cup portion to a rim of the cup portion.

In yet a further embodiment, the base of the cup portion comprises a substantially flat bottom wall, the substantially flat bottom wall of the base having an outer diameter.

In still a further embodiment, the shaker ball has an outer diameter that is substantially equal to the outer diameter of the substantially flat bottom wall of the base of the cup portion.

In yet a further embodiment, the rim of the cup portion is inwardly recessed relative to the circular sidewall of the cup portion.

In still a further embodiment, the lid portion has a generally hemispherical body with a collar disposed at a base of the generally hemispherical body.

In yet a further embodiment, the collar protrudes outwardly from the generally hemispherical body of the lid portion.

In still a further embodiment, the lid portion further includes a substantially flat portion at a top of the generally hemispherical body.

In yet a further embodiment, the cup portion has a volumetric capacity of approximately 300 milliliters.

In still a further embodiment, the shaker ball is generally spherical in shape.

In yet a further embodiment, the shaker ball is formed from a wire wrapped in a shape of a sphere.

In still a further embodiment, wrapped portions of the wire forming the shaker ball are spaced apart from one another by respective gaps such that a series of circumferential gaps are formed on the sphere.

In yet a further embodiment, the shaker ball has a hollow interior.

In accordance with one or more other embodiments of the present invention, there is provided a method of applying touch-up paint using a cup assembly. The cup assembly includes a cup portion, the cup portion including a fluid reservoir configured to hold a volume of touch-up paint; a lid portion, the lid portion configured to matingly engage with the cup portion in a substantially airtight manner so as to prevent the volume of touch-up paint from solidifying; and a shaker ball disposed inside the fluid reservoir of the cup portion, the shaker ball configured to mix the volume of touch-up paint in the fluid reservoir. The method comprises the steps of: (i) providing a cup assembly; (ii) filling the fluid reservoir of the cup portion of the cup assembly with a volume of touch-up paint; (iii) mixing the volume of touch-up paint in the fluid reservoir of the cup portion by shaking the cup assembly so that the shaker ball agitates the touch-up paint; (iv) dipping a paintbrush into the volume of the touch-up paint in the fluid reservoir of the cup portion; (v) applying the touch-up paint to one or more surfaces using the paintbrush; and (vi) after the touch-up paint has been applied to the one or more surfaces, engaging the lid portion of the cup assembly with the cup portion of the cup assembly in a substantially airtight manner so that the volume of touch-up paint does not solidify inside the cup portion.

In a further embodiment of the present invention, the cup portion further includes a rim with a plurality of external threads disposed thereon, and the lid portion further includes collar with a plurality of internal threads disposed thereon. Also, in this further embodiment, the step of engaging the lid portion with the cup portion comprises matingly engaging the plurality of external threads on the cup portion with the plurality of internal threads on the lid portion in a substantially airtight manner.

In yet a further embodiment, the cup portion of the cup assembly has a volumetric capacity of approximately 300 milliliters.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 2:
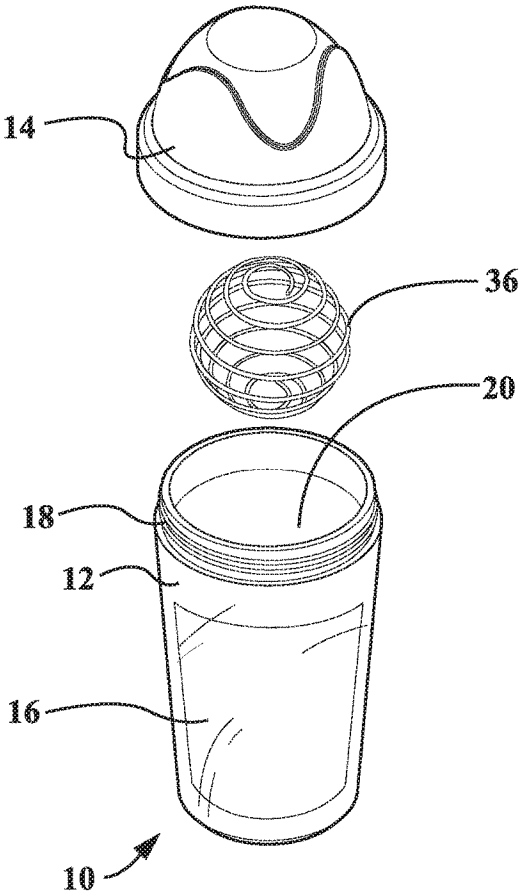
FIG. 2 is an exploded perspective view of the cup assembly of FIG. 1.

An illustrative embodiment of the cup assembly for holding touch-up paint is seen generally at 10 in FIGS. 1-4. As shown in these figures, the cup assembly 10 generally comprises a cup portion 12, the cup portion 12 including a fluid reservoir or fluid receiving cavity 20 configured to hold a volume of touch-up paint 32; a lid portion 14, the lid portion 14 configured to matingly engage with the cup portion 12 in a substantially airtight manner so as to prevent the volume of touch-up paint 32 from solidifying; and a shaker ball 36 disposed inside the fluid reservoir 20 of the cup portion 12, the shaker ball 36 configured to agitate the volume of touch-up paint 32 in the fluid reservoir 20. Each of these cup assembly components 12, 14, 36 will be described in detail hereinafter.

Figure 4:
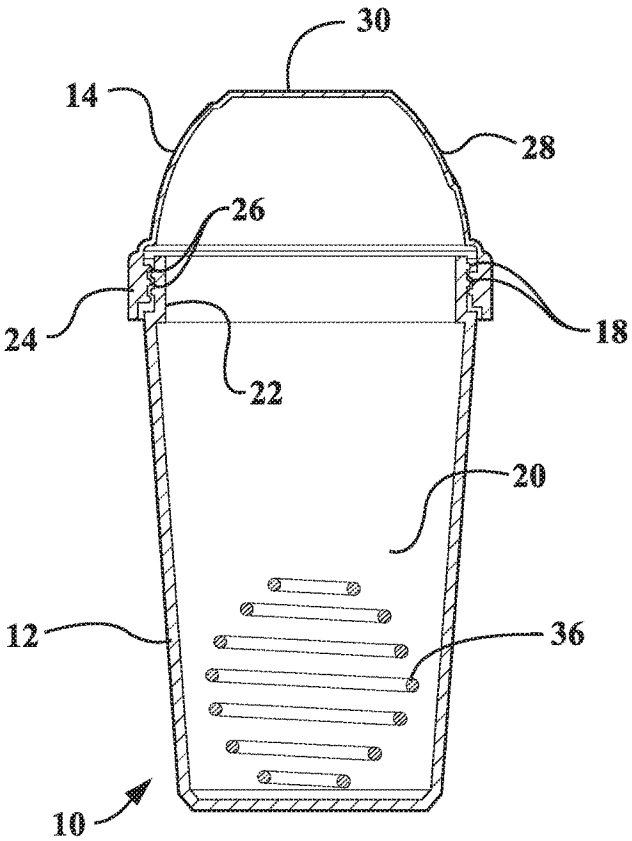
FIG. 4 is a longitudinal sectional view cut through the cup assembly of FIG. 1, wherein the sectional view is generally cut along the cutting-plane line A-A in FIG. 3.
Figure 3:
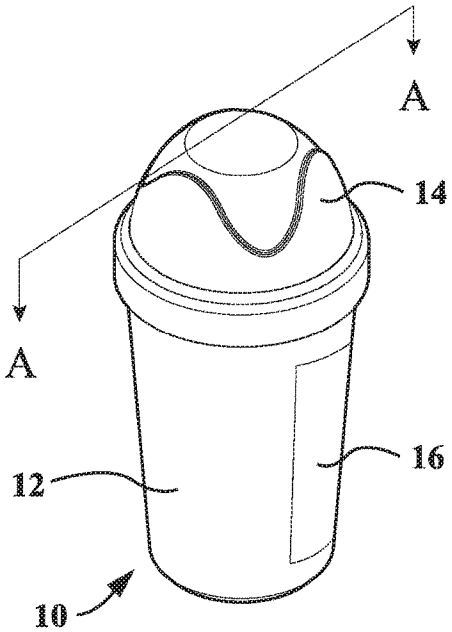
FIG. 3 is another assembled perspective view of the cup assembly of FIG. 1, wherein the section cutting-plane line A-A is illustrated thereon.
Figure 5:
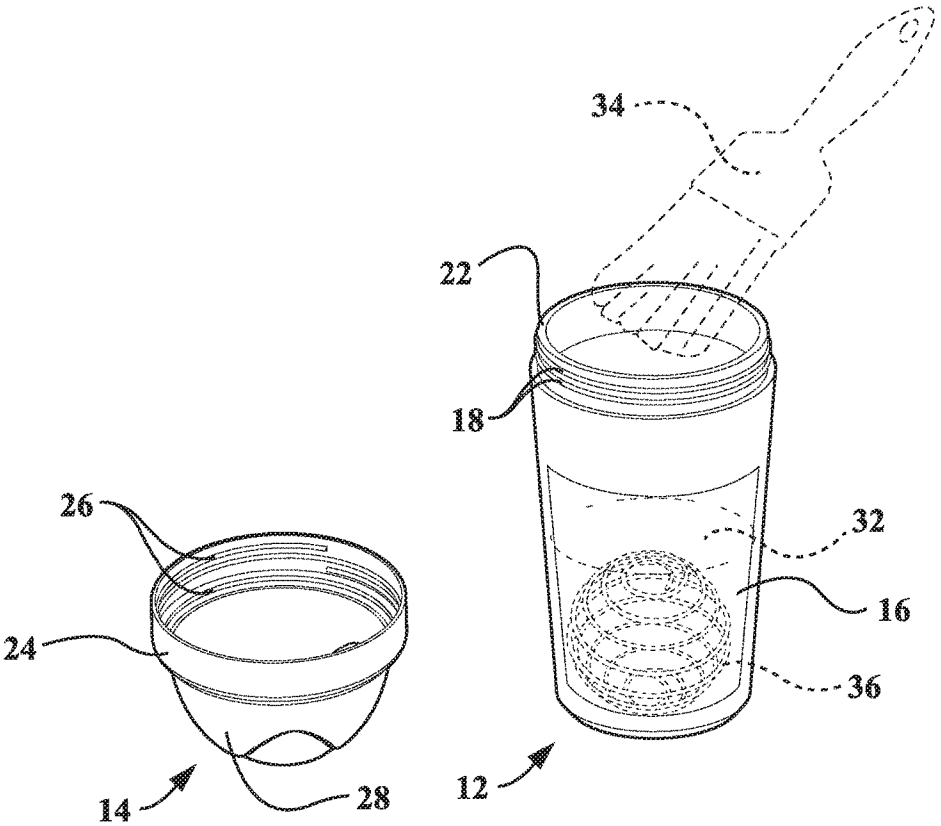
FIG. 5 is yet another perspective view of the cup assembly of FIG. 1, wherein the lid portion is removed from the cup portion of the cup assembly and a paintbrush is shown entering the cup portion of the cup assembly.

Initially, with reference to FIGS. 2, 4, and 5, it can be seen that cup portion 12 of the cup assembly 10 includes a rim 22 with a plurality of external threads 18 disposed thereon, and the lid portion 14 of the cup assembly 10 includes collar 24 with a plurality of internal threads 26 disposed thereon. The plurality of external threads 18 on the cup portion 12 are configured to matingly engage with the plurality of internal threads 26 on the lid portion 14 in a substantially airtight manner (i.e., the cup assembly 10 is provided with a screw-type lid 14 for maintaining a generally airtight paint receiving cavity 20 with minimal air leakage that is insufficient to cause the paint to solidify). Also, as shown in the illustrative embodiment of FIGS. 1-5, it can be seen that the cup portion 12 has a generally cylindrical shape with a circular sidewall that has a slight outward taper from a base of the cup portion 12 to a rim 22 of the cup portion 12. The rim 22 of the cup portion 12 with threads 18 is inwardly recessed relative to the circular sidewall of the cup portion 12 (refer to FIGS. 2, 4, and 5). Advantageously, the inwardly recessed configuration of the rim 22 of the cup portion 12 is stepped inwardly so as to create a generally horizontal bottom rim ledge inside the paint receiving cavity 20 of the cup portion 12 that is particularly useful for cleaning excess paint from paintbrushes during painting. That is, the bristles of the paintbrush may be slid against the horizontal ledge at the bottom of the rim 22 in order to extract excess paint from the paintbrush (e.g., between paint strokes or when the painting job is complete). In addition, as illustrated in FIGS. 1-3 and 5, an exterior surface of the circular sidewall of the cup portion 12 includes a label area 16 for accommodating a label (e.g., a rectangular area 16 that is recessed with respect to the remainder of the cup circular sidewall so that the outer surface of the label is disposed generally flush with the exterior surface of the sidewall when the label is disposed on the cup portion 12).

As best shown in the cross-sectional view of FIG. 4, it can be seen that the base of the cup portion 12 comprises a substantially flat bottom wall, which defines the bottom wall of the paint receiving cavity 20. Also, as shown in this figure, the substantially flat bottom wall of the base of the cup portion 12 has an outer diameter (e.g., where the flat bottom wall of the base meets the outwardly tapered sidewall of the cup portion 12). In the illustrative embodiment of FIG. 4, it further can be seen that the shaker ball 36 has an outer diameter that is substantially equal to the outer diameter of the substantially flat bottom wall of the base of the cup portion 12 (e.g., the outer diameter of the shaker ball 36 is equal to approximately 90% of the outer diameter of the substantially flat bottom wall of the base). Advantageously, because the shaker ball 36 is almost as large as the base diameter of the paint receiving cavity 20, the shaker ball 36 is capable of quickly and efficiently mixing/stirring the volume of touch-up paint 32 disposed in the paint receiving cavity 20 of the cup portion of the cup assembly 10. That is, because the shaker ball 36 spans a large region within the paint receiving cavity 20, it is capable of mixing the touch-up paint 32 more effectively than a small shaker ball, which has a diameter that is much smaller than the base diameter of the paint receiving cavity 20 (e.g., a small shaker ball that is only equal to approximately 10% of the outer diameter of the substantially flat bottom wall of the base). In an exemplary embodiment, the shaker ball 36 has an outer diameter that is at least 90% of the outer diameter of the substantially flat bottom wall of the base).

In an exemplary embodiment, the fluid reservoir or fluid receiving cavity 20 of the cup portion 12 has a volumetric capacity of approximately 300 milliliters. This volumetric capacity is large enough for holding a sufficient amount of touch-up paint, while not being overly large so as to avoid an unduly cumbersome cup portion 12. Also, in an exemplary embodiment, the cup portion 12 has an overall height of approximately 110 millimeters, and the label area 16 has a height of approximately 80 millimeters.

Now, referring to the illustrative embodiment of FIGS. 1-4, it can be seen that the lid portion 14 has a generally hemispherical body 28 with the internally-threaded collar 24 disposed at the base of the generally hemispherical body 28. As best shown in FIGS. 2 and 4, the internally-threaded collar 24 protrudes outwardly from the generally hemispherical body 28 of the lid portion 14. In addition, as most clearly illustrated in the longitudinal section view of FIG. 4, the lid portion 14 further includes a substantially flat portion 30 at a top of its generally hemispherical body 28. In the illustrative embodiment, the generally hemispherical body 28 of the lid portion 14 defines an interior cavity that is generally large enough to accommodate the shaker ball 36 therein (i.e., so the shaker ball 36 is able to enter the interior cavity of the hemispherical body 28 of the lid portion 14 when a user shakes the cup assembly 10 to mix the paint disposed therein, thereby resulting in an improved mixing of the paint). In an exemplary embodiment, the lid portion 14 has an overall height of approximately 50 millimeters (i.e., from the bottom edge of the collar 24 to the upper surface of the substantially flat portion 30).

Next, turning to FIGS. 1-2 and 4-5, it can be seen that the shaker ball 36, which is disposed inside the fluid reservoir 20 of the cup portion 12, is generally spherical in shape with a hollow interior. In one or more embodiments, the shaker ball 36 is formed from a wire wrapped in a shape of a sphere (e.g., a deformable metal wire bent in the shape of a sphere). In these one or more embodiments, the wrapped portions of the wire forming the shaker ball 36 are spaced apart from one another by respective gaps such that a series of circumferential gaps are formed on the sphere (see FIGS. 1-2 and 4-5). Advantageously, the shaker ball 36 may be used to agitate the touch-up paint inside the fluid reservoir 20 of the cup portion 12 when the cup assembly 10 is shook by a user. That way, the touch-up paint is able to be properly mixed and stirred by a user prior to the use thereof. In an exemplary embodiment, the shaker ball 36 has a diameter of approximately 5 centimeters (or 50 millimeters).

In one or more embodiments, the cup portion 12 and the lid portion 14 of the cup assembly 10 are formed from a generally rigid plastic or polymeric material, so that these components 12, 14 are sufficiently strong and lightweight. For example, the cup portion 12 and the lid portion 14 of the cup assembly 10 may be molded from a suitable plastic material, such polyethylene, polypropylene, or polyvinyl chloride (PVC).

In an exemplary embodiment, the assembled cup assembly 10 has an overall height of approximately 16 centimeters (or 160 millimeters), the mouth diameter of the cup portion 12 of the cup assembly 10 is approximately 7.3 centimeters (or 73 millimeters) at its rim 22, and the bottom diameter of the cup portion 12 is approximately 4.6 centimeters (or 46 millimeters) at its flat base.

Figure 1:
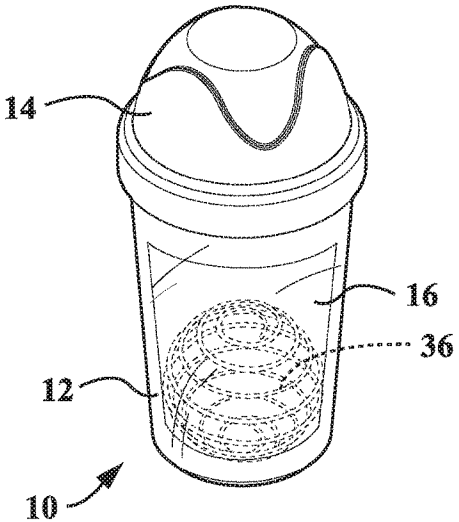
FIG. 1 is an assembled perspective view of a cup assembly for holding touch-up paint, according to an embodiment of the invention.

Now, referring primarily to FIGS. 1 and 5, a method of applying touch-up paint, which utilizes the components of the cup assembly 10, will be described in detail. Initially, a user fills the fluid reservoir 20 of the cup portion 12 with a volume of touch-up paint 32 (refer to FIG. 5). Then, after filling the cup portion 12 with the touch-up paint 32 and engaging the lid portion 14 with the cup portion 12, the user mixes and/or stirs the volume of touch-up paint 32 in the fluid reservoir of the cup portion 12 by repeatedly shaking the cup assembly 10 so that the shaker ball 36 agitates the touch-up paint 32. Next, after removing the lid portion 14 from the cup portion 12, the user dips a paintbrush 34 (see FIG. 5) into the volume of the touch-up paint 32 in the fluid reservoir 20 of the cup portion 12 so that the touch-up paint 32 is adhered to the bristles of the paintbrush 34. After the paintbrush 34 contains a sufficient amount of touch-up paint thereon, the user applies the touch-up paint to one or more surfaces (e.g., one or more walls or ceilings inside a building) using the paintbrush 34. Finally, after the touch-up paint has been applied to the one or more surfaces (e.g., to the one or more walls or ceilings), the user reengages the lid portion 14 of the cup assembly 10 with the cup portion 12 of the cup assembly 10 in a substantially airtight manner so that the volume of touch-up paint 32 does not solidify inside the cup portion 12. For example, in the illustrative embodiment, the user reengages the lid portion 14 with the cup portion 12 by matingly engaging the plurality of external threads 18 on the cup portion 12 with the plurality of internal threads 26 on the lid portion 14 in a substantially airtight manner (e.g., the user screws the lid portion 14 onto the cup portion 12 to ensure the general airtightness of the paint reservoir 20 of the cup portion 12).

It is readily apparent that the aforedescribed cup assembly 10 and the method of using the same offers numerous advantages. First, the cup assembly 10 for holding touch-up paint includes an integral means (i.e., the shaker ball 36) for agitating or stirring the paint stored in the cup so that a separate paint stirrer or paddle is not required for mixing the touch-up paint. Secondly, the paint cup assembly 10 described above is capable of storing the touch-up paint 32 disposed therein in a generally airtight manner so that the paint 32 does not dry up between the uses thereof. Thirdly, the paint cup assembly 10 described herein is specifically configured to accommodate a relatively small volume of touch-up paint 32 for enabling a user to conveniently touch up interior surfaces, such as walls, trim, ceilings, and doors. Finally, the aforementioned method of applying touch-up paint that utilizes the paint cup assembly 10 significantly facilitates the ease by which an interior surface may be touched up with paint.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A cup assembly for holding touch-up paint, comprising:

a cup portion, said cup portion including a fluid reservoir configured to hold a volume of touch-up paint, said cup portion including a circular sidewall and a rim at a top of said circular sidewall, said rim of said cup portion being inwardly recessed relative to said circular sidewall of said cup portion, and said rim of said cup portion including a plurality of external threads disposed on an outer peripheral surface of said rim;

a lid portion, said lid portion configured to matingly engage with said cup portion in a substantially airtight manner so as to prevent said volume of touch-up paint from solidifying, said lid portion being imperforate so as to further prevent said volume of touch-up paint from solidifying, said lid portion comprising a continuous solid wall having an exterior surface and an interior surface disposed opposite to said exterior surface, said interior surface of said continuous solid wall forming an imperforate top surface over an entire top of said fluid reservoir when said lid portion is matingly engaged with said cup portion, said lid portion further comprising a collar with a plurality of internal threads disposed thereon, said plurality of internal threads being distributed across more than one-half of a height of said collar, said plurality of internal threads on said lid portion being configured to matingly engage with said plurality of external threads on said rim of said cup portion in a substantially airtight manner; and a shaker ball disposed inside said fluid reservoir of said cup portion, said shaker ball configured to agitate said volume of touch-up paint in said fluid reservoir.

2. The cup assembly according to claim 1, wherein an exterior surface of said cup portion further includes an area for accommodating a label.

3. The cup assembly according to claim 1, wherein said cup portion has a generally cylindrical shape, and said circular sidewall of said cup portion has a slight outward taper from a base of said cup portion to said rim of said cup portion.

4. The cup assembly according to claim 3, wherein said base of said cup portion comprises a substantially flat bottom wall, said substantially flat bottom wall of said base having an outer diameter.

5. The cup assembly according to claim 4, wherein said shaker ball has an outer diameter that is substantially equal to said outer diameter of said substantially flat bottom wall of said base of said cup portion.

6. The cup assembly according to claim 1, wherein said lid portion has a generally hemispherical body with said collar disposed at a base of said generally hemispherical body.

7. The cup assembly according to claim 6, wherein said collar protrudes outwardly from said generally hemispherical body of said lid portion.

8. The cup assembly according to claim 6, wherein said lid portion further includes a substantially flat portion at a top of said generally hemispherical body.

9. The cup assembly according to claim 1, wherein said cup portion has a volumetric capacity of approximately 300 milliliters.

10. The cup assembly according to claim 1, wherein said shaker ball is generally spherical in shape.

11. The cup assembly according to claim 1, wherein said shaker ball is formed from a wire wrapped in a shape of a sphere.

12. The cup assembly according to claim 11, wherein wrapped portions of said wire forming said shaker ball are spaced apart from one another by respective gaps such that a series of circumferential gaps are formed on said sphere.

13. The cup assembly according to claim 11, wherein said shaker ball has a hollow interior.

14. The cup assembly according to claim 1, wherein said cup portion further comprises a base with a bottom wall, said bottom wall having an outer diameter; and wherein said shaker ball has an outer diameter that is at least 90% of said outer diameter of said bottom wall of said base of said cup portion.

15. A touch-up cup assembly, comprising:

a cup portion, said cup portion including a fluid reservoir defining a fluid receiving volume, said cup portion including a base with a bottom wall, said bottom wall having an outer diameter, said cup portion further including a circular sidewall and a rim at a top of said circular sidewall, said rim of said cup portion being inwardly recessed relative to said circular sidewall of said cup portion, and said rim of said cup portion including a plurality of external threads disposed on an outer peripheral surface of said rim, said cup portion additionally including a ledge disposed at a bottom edge of said rim directly beneath said plurality of external threads, said ledge protruding outwardly from said cup portion further than said plurality of external threads;

touch-up paint occupying at least a portion of said fluid receiving volume of said fluid reservoir of said cup portion;

a lid portion, said lid portion configured to matingly engage with said cup portion in a substantially airtight manner so as to prevent said touch-up paint in said fluid reservoir from solidifying, said lid portion being imperforate so as to further prevent said touch-up paint in said fluid reservoir from solidifying; and a shaker ball disposed inside said fluid reservoir of said cup portion, said shaker ball having an outer diameter that is at least 90% of said outer diameter of said bottom wall of said base of said cup portion, said shaker ball configured to agitate said touch-up paint in said fluid reservoir.

16. The touch-up cup assembly according to claim 15, wherein said lid portion comprises a continuous solid wall having an exterior surface and an interior surface disposed opposite to said exterior surface, said interior surface of said continuous solid wall forming an imperforate top surface over an entire top of said fluid reservoir when said lid portion is matingly engaged with said cup portion; and wherein said cup portion has a volumetric capacity of approximately 300 milliliters.

17. The touch-up cup assembly according to claim 15, wherein said lid portion comprises a collar with a plurality of internal threads disposed thereon, said plurality of internal threads being distributed across more than one-half of a height of said collar, said plurality of internal threads on said lid portion being configured to matingly engage with said plurality of external threads on said rim of said cup portion in a substantially airtight manner.

* * * * *